US006035779A

United States Patent [19]

Helms

[11] Patent Number: 6,035,779

[45] Date of Patent: Mar. 14, 2000

[54] IN-LINE BELT-TYPE PRINTER

[76] Inventor: Tommy Albert Helms, 8823 Whippoorwill La., Fort Mill, S.C. 29715

[21] Appl. No.: 09/089,851

[22] Filed: Jun. 3, 1998

Related U.S. Application Data

[63] Continuation-in-part of application No. 08/707,975, Aug. 30, 1996, abandoned.

[51] Int. Cl.[7] ..... B41F 9/00

[52] U.S. Cl. ..... 101/153; 101/DIG. 48; 101/170

[58] Field of Search ..... 101/216, 217, 101/219, 171, 174, 177, 178, 179–182, 136–140, 141–145, DIG. 48, 483, 492, 493, 170, 150, 153

[56] References Cited

U.S. PATENT DOCUMENTS

| | | | |
|---|---|---|---|
| 3,329,088 | 7/1967 | Rockefeller, Jr. | 101/DIG. 48 |
| 5,009,157 | 4/1991 | Rogge et al. | 101/178 |
| 5,421,255 | 6/1995 | Kryk | 101/DIG. 48 |
| 5,456,171 | 10/1995 | Biava et al. | 101/122 |

FOREIGN PATENT DOCUMENTS

| | | | |
|---|---|---|---|
| 2 079 221 | 1/1982 | United Kingdom | 101/DIG. 48 |
| 2 160 820 | 1/1986 | United Kingdom | 101/DIG. 48 |

*Primary Examiner*—Christopher A. Bennett
*Attorney, Agent, or Firm*—Dougherty & Associates

[57] ABSTRACT

The present invention is a flexographic printing apparatus for printing single images on a continuous web of material using a belt-type printer and for easily and rapidly creating flexible packaging by bringing the printing operation in-line with the bag converting or packaging material machines. In a preferred embodiment, the printing apparatus includes a frame having an impression cylinder and a nip roller rotatably mounted to the frame in close proximity to the impression cylinder such that the nip roller bears on the impression cylinder, a printer mounting attached to the frame and movable laterally relative to the impression cylinder, a belt-type printer mounted on the printer mounting and means for transferring rotation of the impression cylinder to the printer. The frame may be fixed to a post-printing processing machine or may be free-standing for easily moving the invented apparatus to various locations. Thus, the invented printing apparatus enables the belt-type printer to be used in-line with the post-printing processing machine. The impression cylinder is rotatably driven by a continuous web of non-rigid material being pulled through the printing apparatus by the in-line post-printing processing machine. The transfer means enables the printer to be operated solely by the rotation of the impression cylinder. Preferably, the printing mount is slidable on the frame laterally with respect to the impression cylinder for locating images at any desired position on the continuous web of non-rigid material.

23 Claims, 4 Drawing Sheets

IN-LINE BELT-TYPE PRINTER

CROSS-REFERENCE TO RELATED APPLICATIONS

This application is a continuation-in-part of U.S. patent application Ser. No. 08/707,975 filed Aug. 30, 1996, now abandoned.

FIELD OF THE INVENTION

The present invention relates to flexographic printers. More particularly, the invention relates to a printing apparatus that includes a belt-type printer slidably mounted on a frame both of which are operated by a continuous web of non-rigid material being pulled through the printing apparatus by an in-line post-printing processing machine.

BACKGROUND

"Flexible packaging" is used to package a large number of consumer products. Existing methods for creating flexible packaging involve printing indicia, such as logos, product information, labels, etc., on a non-rigid material, such as polypropylene, polyethylene, foil or paper. Typically, a continuous web of a selected non-rigid material in roll form is fed into a "flexographic press" which repeatedly prints the desired indicia on the passing web of non-rigid material. After printing, the web of non-rigid material is gathered in printed roll form. The printed roll is then transported to a bag converting or packaging material machine and converted to individual packaging, and the flexographic press is outfitted with a new roll of non-rigid material. This step significantly slows the process of making flexible packaging. Further, because the bag converting or packaging machines are remote from the flexographic press, the entire operation requires an unnecessarily large area.

Attempts at creating in-line printers have been prohibitive, either because the printers are too large or because the printers are incapable of repetitiously printing an image at a desired increment (knwon in the art as a "repeat"). Typically, such printers include numerous print cylinders and require a significant amount of time to set up. The present invention, by using a belt-type printer eliminates the need to store a large number of cylinders. It also offers large repeats while maintaining compactness, and the ability to print in desired increments.

Needs, therefore, exist for a printing apparatus that brings a printer "in-line" with bag converting or packaging material machines thereby eliminating the existing "out-of-line" process.

Belt-type printing machines, such as the one disclosed in U.S. Pat. No. 4,817,525 to Yagi, are well known. The Yagi belt-type printing machine includes an endless printing belt detachably wound around a plate cylinder and an adjustable tensioning roll. The plate cylinder is operated by the motor of a main drive having a power transmission system. The Yagi belt-type printing machine also includes means for synchronously controlling a printing speed of the belt-type printing machine.

While there are numerous methods and means for creating flexible packaging, none are known to be similar to, or to function in the manner of, the present invention.

SUMMARY OF THE INVENTION

The present invention is a flexographic printing apparatus for printing single images on a continuous web of material using a belt-type printer and for easily and rapidly creating flexible packaging by placing the printer in-line with a post-printing processing machine such as bag converting or packaging material machines. The present invention includes a belt-type printer capable of printing a single image or design on a continuous web of non-rigid material, such as foil, paper, film, polypropylene and polyethylene. Preferably, the non-rigid material is in roll form and is mounted in a manner that permits easy feeding of the non-rigid material into the printer. In operation, the post-printing processing machine pulls the continuous web of non-rigid material through the invented printing apparatus thereby operating the belt-type printer. Means for transferring rotation of the impression cylinder to the printer are also provided such that the printer can be operated solely by the force of the continuous web of non-rigid material.

The flexographic printing apparatus includes a frame, a printer mounted on the frame and a belt-type printer partially mounted on the printer mounting. Preferably, the frame is self-supporting and free-standing for maneuverability to desirable operating positions around machinery. An impression cylinder and a nip roller are journaled for rotation in bearings mounted on each of the frame posts.

In a preferred embodiment, the frame has an upper cross rail and a lower cross rail positioned between two upright frame posts, and the printer mounting slidably mounted on the upper cross rail of the frame. Consequently, the printer and frame can be readily placed in a desired position in-line with machinery performing a related or final process as in bag converting or packaging material machinery. In operations, such as film extrusion, where the print direction and the material web location remain unchanged, the mounting stand can be fixedly attached to such machinery.

The present invention is intended primarily for use in conjunction with existing post-printing processing machines. The present invention eliminates the need for numerous print cylinders and gears, while maintaining the ability of the printer to print at desired increments by changing belts, and allowing larger repeats than previously obtainable by existing print cylinders. Printing plate-carrying belts are of any desired length with printing plates adhered to the surface of the belts with non-permanent adhesive. Thus, the invented printing apparatus is capable of printing single images at various repeat increments by changing the printer's plate-carrying belt.

The transfer means is a driveshaft coupled to the plate cylinder of the printer, a gear secured to the driveshaft and a gear secured to the impression cylinder. The driveshaft gear is aligned for engagement with the gear on the impression cylinder. Consequently, rotation of the impression cylinder translates into rotation of the plate cylinder. In a preferred embodiment, the driveshaft is movable laterally with respect to the impression cylinder such that the driveshaft gear can remain aligned with the gear on the impression cylinder when the printer is moved laterally along the upper cross rail of the frame.

OBJECTS OF THE INVENTION

Accordingly, a principle object of the present invention is to provide a flexographic printing apparatus that enables the printer to be placed in-line with a post-printing processing machine.

A further, and more particular, object of the invention is to provide a belt-type printer mounted on a self-supporting and free-standing frame that can be easily maneuvered to needed positions around any of several post-printing processing machines.

Another object of the invention is to provide a flexographic printing apparatus that operates solely by a continuous web of non-rigid material being pulled through the printing apparatus by a post-printing machine.

Another object of the invention is to provide a belt-type printer that can be laterally adjusted for printing in several horizontal locations on a continuous web of non-rigid material.

Another object of the invention is to provide a flexographic printing apparatus that allows larger repeats than previously obtainable by existing print cylinders.

It is also an object of the invention is to provide a flexographic printing apparatus that is quiet, simple and inexpensive.

BRIEF DESCRIPTION OF THE DRAWINGS

The foregoing and other objects will become more readily apparent by referring to the following detailed description and the appended drawings, in which.

DETAILED DESCRIPTION

Figure 7:
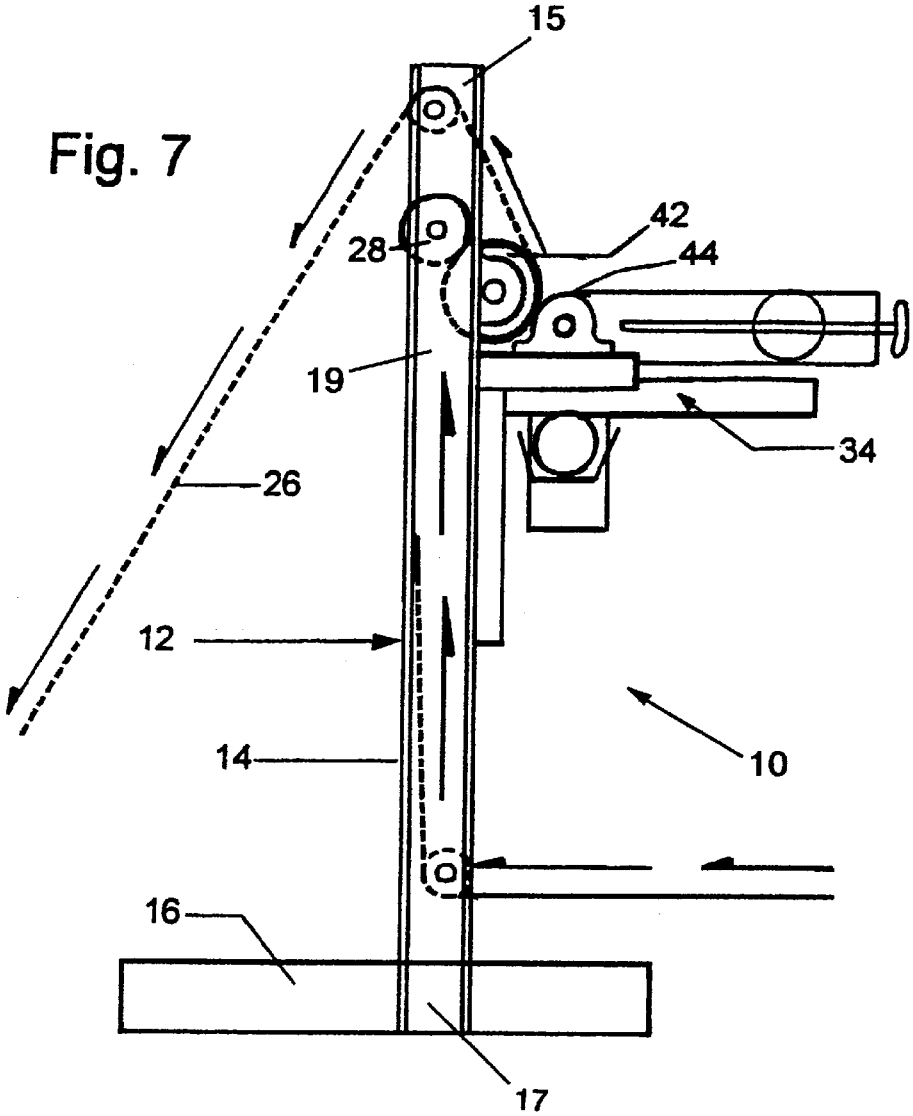
FIG. 7 is a side view of the flexographic printing apparatus of FIG. 6.
Figure 6:
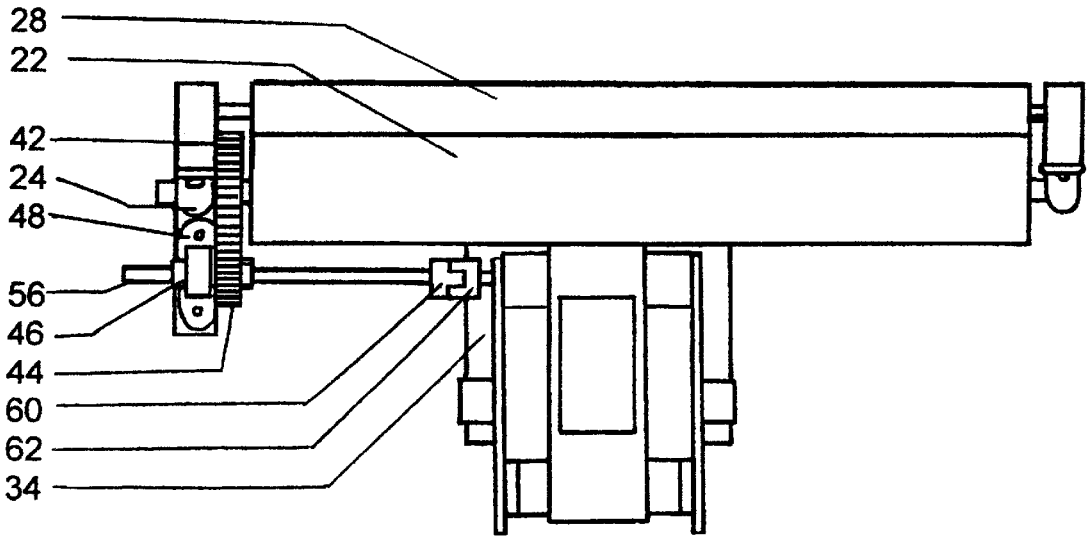
FIG. 6 is top view of the invented flexographic printing apparatus showing a belt-type printer mounted on the frame of FIG. 1.

Referring first to FIGS. 6 and 7, the present invention is a flexographic printing apparatus 10 for printing single images on a continuous web of material using a belt-type printer and for enabling a belt-type printer to be positioned in-line with a post-printing processing machine (not shown). In a preferred embodiment, the invented printing apparatus 10 includes a free-standing and self-supporting frame 12, a printer mounting 34 adjustably mounted on the frame 12, a belt-type printer 40 mounted on the printer mounting 34 and means for transferring rotation of the impression cylinder 22 to the printer 40.

Figure 1:
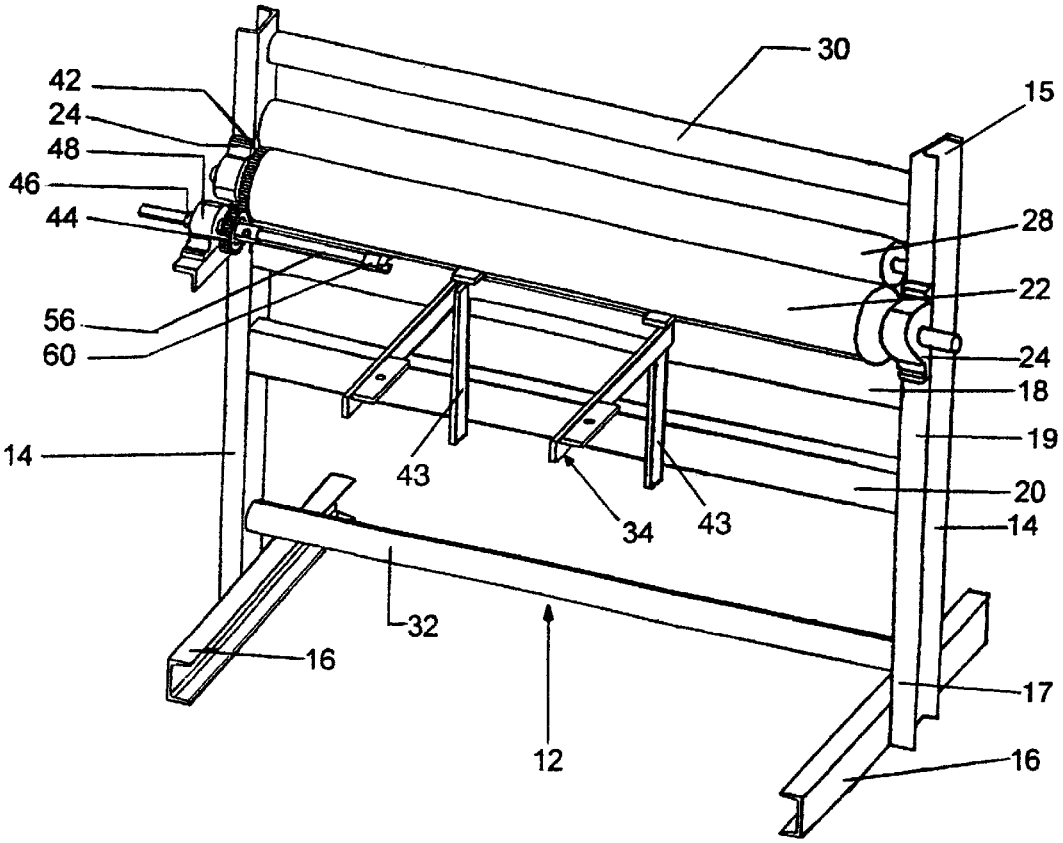
FIG. 1 is an isometric view of a preferred embodiment of the frame of the invented flexographic printing apparatus.

As shown in FIG. 1, the frame 12 includes a pair of spaced feet 16 and a pair of posts 14 having upper ends 15 and lower ends 17 perpendicularly extending from said spaced feet 16. The frame 12 also has an upper cross rail 18 and a lower cross rail 20 extending between middle regions 19 of the frame posts 14 connecting the frame posts 14 together.

An impression cylinder 22 is journaled for rotation in bearings 24 mounted to each of the frame posts 14. The impression cylinder 22 is located on the frame posts 14 above the upper cross rail 18. Typically, a drive for the impression cylinder 22 will not be necessary because the continuous web 26 of non-rigid material being pulled through the invented printing apparatus 10 by a post-printing processing machine will cause the impression cylinder 22 to rotate. However, if necessary, a supplemental main drive (not shown) may be used to operate the impression cylinder 22.

Figure 5:
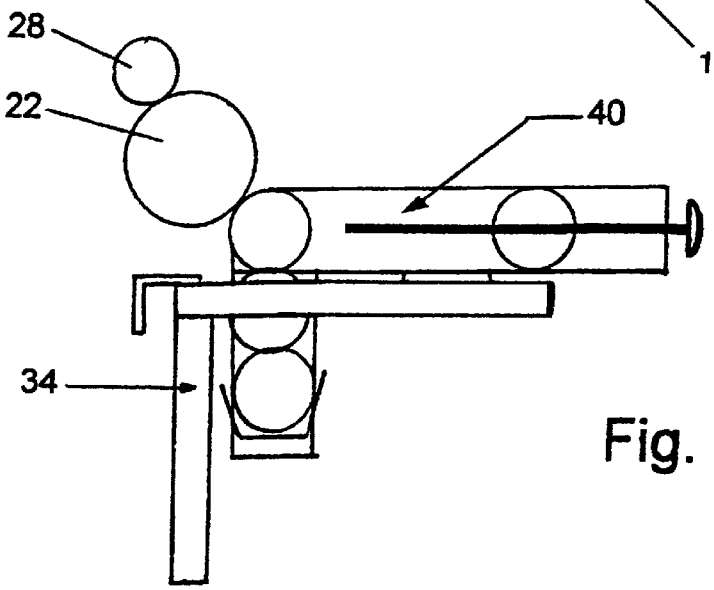
FIG. 5 is a schematic side view showing the belt-type printer mounted on the printer mounting in relation to the impression cylinder and the nipper roller.

A nip roller 28 is rotatably mounted to the frame posts 14 and is located above the impression cylinder 22. As shown in FIG. 5, the nip roller 28 is in close proximity to the impression cylinder 22 such that the nip roller 28 bears on the impression cylinder 22. Preferably, the nip roller 28 is coated with rubber to prevent slippage of the continuous web of non-rigid material as it passes between the rollers 22, 28 by pressing onto the impression cylinder 22 as tension is applied to the continuous web of non-rigid material.

Finally, an upper idler roller 30 is rotatably mounted between the upper ends 15 of the frame posts 14 and a lower idler roller 32 is rotatably mounted between the lower ends 17 of the frame posts 14. As shown in detail in FIG. 7, the idler rollers 30, 32 train the continuous web 26 of non-rigid material as it passes through the frame 12.

Figure 4:
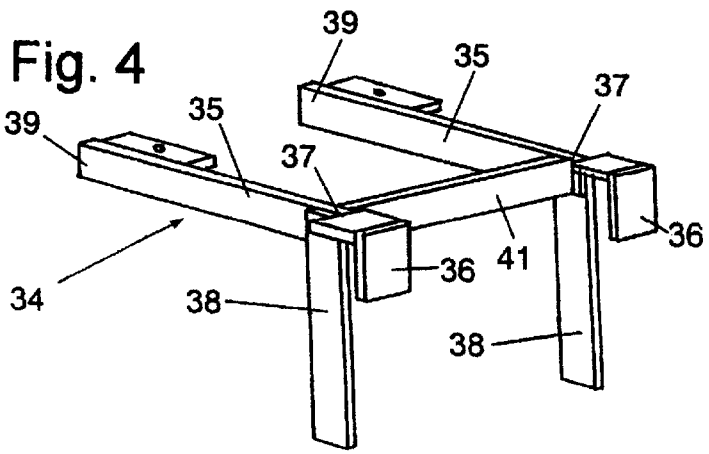
FIG. 4 is an isometric view of a printer mounting for mounting the belt-type printer on the frame of FIG. 1.

The invented printing apparatus 10 also includes a printer mounting 34 movable on the upper cross rail 18 of the frame 12. As shown in detail in FIG. 4, the printer mounting 34 includes a pair of spaced arms 35 having opposed ends 37, 39, a leg 38 extending generally downwardly from first ends 37 of each of the arms 35, a cross support 41 positioned between the first ends 37 of the arms 35 and means for slidably mounting the printer mounting 34 to the upper cross rail 18. In a preferred embodiment, the arms 35 are aligned generally perpendicular to the axis of the impression cylinder 22. The lower parts 43 of the legs 38 abut the lower cross rail 20 of the frame 12. The mounting means is preferably a pair of hooks 36 extending from the arms 35 of the printer mounting 34. The hooks 36 are positionable over the top of cross rail 18. Thus configured, the printer mounting 34 is movable side to side to enable the attached printer 40 to reach a desired printing location.

A belt-type printer 40 is mounted on the printer mounting 34. The printer 40 and printer mounting 34 can be manually moved laterally relative to the impression cylinder 22. Consequently, images can be printed in several horizontal locations on the continuous web 26 of non-rigid material.

Figure 2:
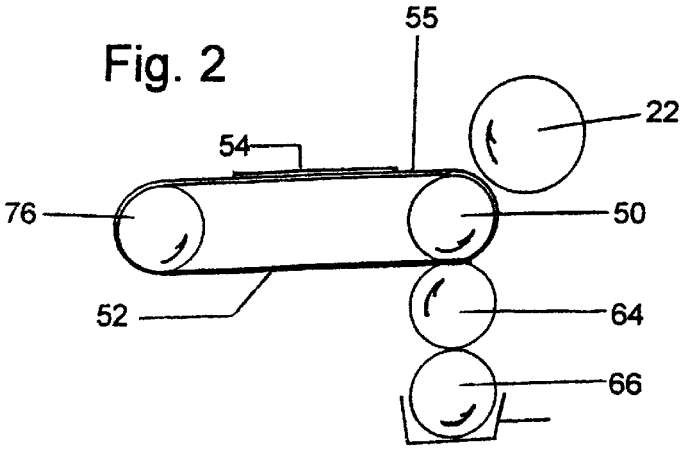
FIG. 2 is a schematic drawing of the roller configuration of a belt-type printer and its printing position in relation to the impression cylinder.
Figure 3:
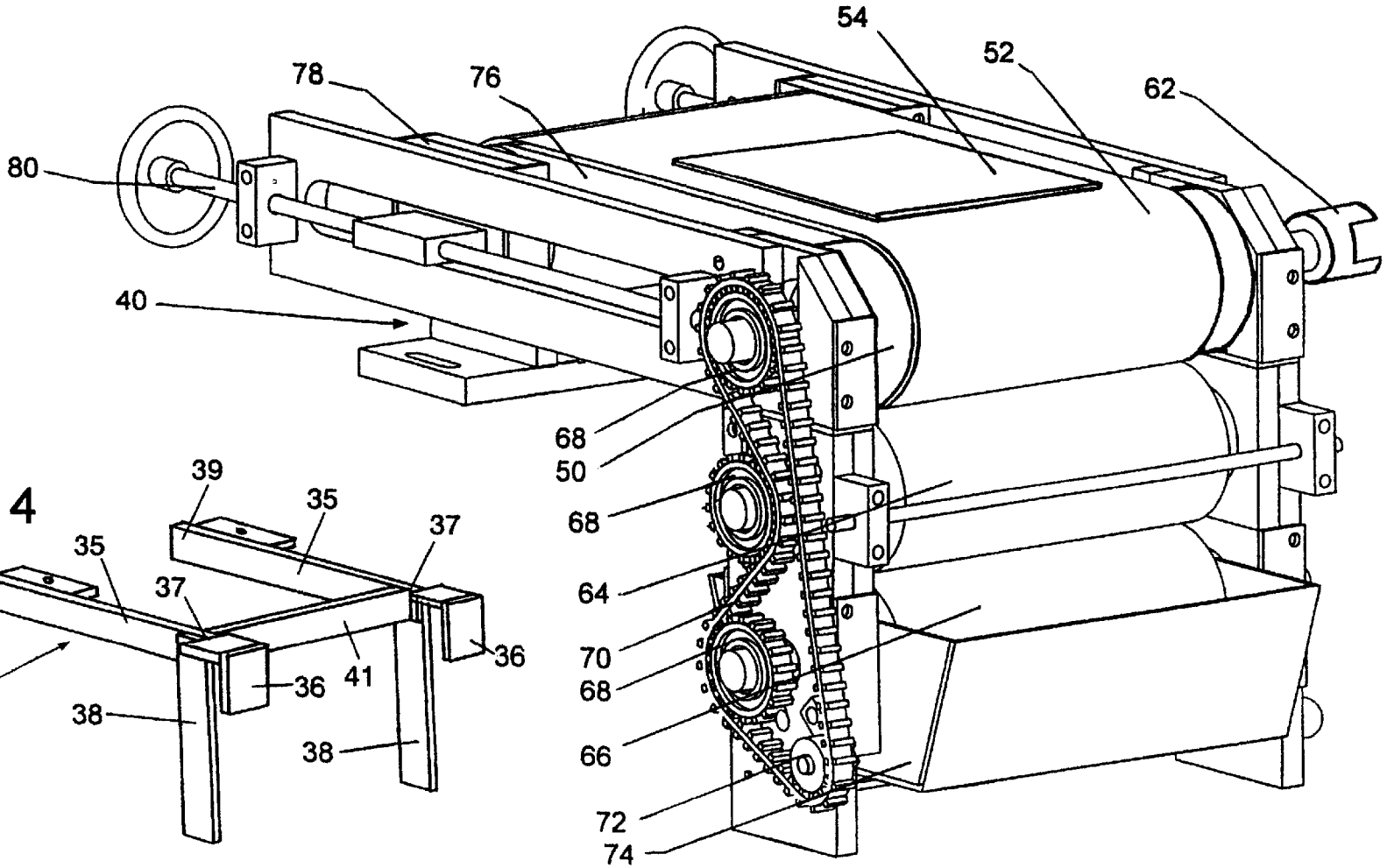
FIG 3 is an isometric view of the belt-type printer having necessary means for transferring ink and for adjusting belt tension and roller rotation.

As shown in FIGS. 2, 3 and 5, the belt-type printer 40 includes a rotatable plate cylinder 50 and an adjustable belt-tensioning roller 76 spaced from the plate cylinder 50 for tensioning belts of different lengths. An endless printing belt 52 is detachably wound around the plate cylinder 50 and the belt-tensioning roller 76 and is driven by friction with the plate cylinder 50. The printer 40 also includes a rotatable rubber ink-carrying roller 66 axially aligned with the plate cylinder 50 for removing ink from an ink reservoir 74 and a rotatable anilox roller 64 axially aligned with the plate cylinder 50 and the ink-carrying roller 66 for transferring the ink removed from the ink reservoir 74 by the ink-carrying roller 66 to a printing plate 54 secured to an outer surface 55 of the printing belt 52. The printing plate 54 has an image formed thereon. Ink transferred onto the printing plate 54 is deposited as an image on the surface of the passing continuous web 26 of non-rigid material. Finally, the printer 40 includes a drive mechanism is provided to maintain timing and rotation of the power cylinder 50, the ink-carrying roller 66, and the anilox roller 64. The drive mechanism includes drive gears 68 mounted to the ends of the power cylinder 50, the ink-carrying roller 66, and the anilox roller 64, a drive belt 70 engaging the drive gears for enabling the power cylinder 50 to rotate the ink-carrying roller 66 and the anilox roller 64 and a drive belt tensioner 72. Thus configured, the belt-type printer 40 can achieve larger repeats while maintaining the compactness of the invented flexographic printing apparatus 10.

Figure 8:
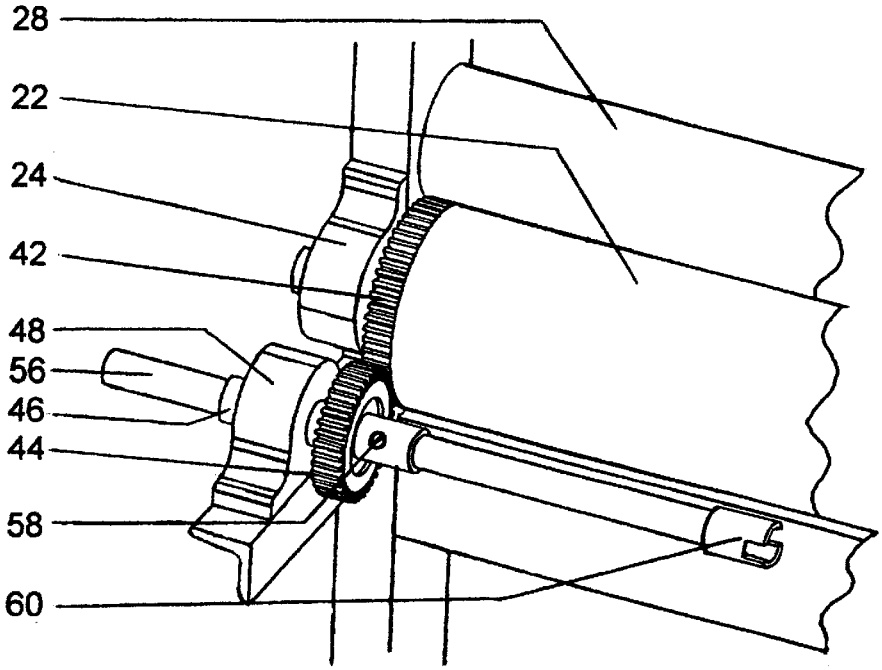
FIG. 8 is a partial sectional isometric view of the means for transferring rotation of the impression cylinder to the printer.

The invented printing apparatus 10 also includes means for transferring rotation of the impression cylinder 22 to the printer 40. As shown in FIGS. 6 and 8, rotation of the impression cylinder 22 is transferred through a series of gears and driveshaft to a printer 40 mounted on the printer mounting 34. The transfer means preferrably includes a driveshaft 56 coupled to the plate cylinder 50 of the printer 40, a gear 44 secured to the driveshaft 56 and a gear 42 secured to the impression cylinder 22. The gear 42 is sized to match the outside diameter of the impression cylinder 22. Set screws can be used to secure gear 42 to the impression cylinder 22. The gear 44 is sized to match the outside diameter of the plate cylinder 50 of the printer 40 and the thickness of the printing belt 52 and printer plate 54. The driveshaft gear 44 is aligned for engagement with the gear 42 on the impression cylinder 22.

In a preferred embodiment, a hollow cylinder 46 is fitted on the driveshaft 56 and extends through a bearing 48 mounted to the frame 12. The driveshaft gear 44 is adjustably secured to the driveshaft 56 with set screw 58. This allows the driveshaft gear 44 to be re-aligned with the gear 42 on the impression cylinder 22 when the printer 40 is moved laterally along the upper cross rail 18 of the frame 12.

The driveshaft 56 also preferrably has a coupling 60 at one end secured thereto by a set screw. The coupling 60 meshes with a coupling 62 of the pressure roller 50 to complete the connection to the printer 40. Thus, drive to the printer 40 is transmitted through driveshaft 56 such that rotation of the impression cylinder 22 translates into rotation of the plate cylinder 50.

As can be clearly understood from the above description, the invented printing apparatus 10 includes a belt-type printer 40 that can print single images at a desired location, at desired repeat increments on a continuous web of material with a belt-type printer, independent of other post-printing processing machines.

SUMMARY OF THE ACHIEVEMENT OF THE OBJECTS OF THE INVENTION

From the foregoing, it is readily apparent that I have invented a flexographic printing apparatus that enables the printer to be placed in-line with a post-printing processing machine. The invented printing apparatus provides a belt-type printer mounted on a self-supporting and free-standing frame that can be easily maneuvered to needed positions around any of several post-printing processing machines. The invented printing apparatus can be operated solely by a continuous web of non-rigid material being pulled through the printing apparatus by a post-printing machine and includes a belt-type printer that can be laterally adjusted for printing in several horizontal locations on a continuous web of non-rigid material. The invented printing apparatus allows larger repeats than previously obtainable by existing print cylinders. Finally, the invented printing apparatus is quiet, simple and inexpensive.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A flexographic printing apparatus for printing on a continuous web of non-rigid material, comprising:

a frame;

an impression cylinder rotatably mounted to said frame;

a nip roller rotatably mounted to said frame in close proximity to said impression cylinder such that said nip roller bears on said impression cylinder;

a printer mounting movable on the frame laterally relative to said impression cylinder; and a belt-type printer mounted on said printer mounting;

wherein said belt-type printer is useable in-line with at least one post-printing processing machine.

2. The printing apparatus of claim 1 wherein said frame is free-standing and self-supporting.

3. The printing apparatus of claim 1 wherein said frame comprises a pair of spaced feet, a pair of posts having upper ends and lower ends perpendicularly extending from said spaced feet and an upper cross rail and a lower cross rail extending between middle regions of said frame posts.

4. The printing apparatus of claim 3 further comprising a bearing mounted to each of said frame posts above said upper cross rail and wherein said impression cylinder is journaled for rotation in said bearings.

5. The printing apparatus of claim 3 wherein said nip roller is rotatably mounted between said frame posts above said impression cylinder.

6. The printing apparatus of claim 1 wherein said nip roller is coated with a non-slip material.

7. The printing apparatus of claim 3 further comprising at least one web-training idler roller mounted to said frame.

8. The printing apparatus of claim 7 wherein said at least one idler roller further comprises an upper idler roller mounted between said upper ends of said frame posts and a lower idler roller mounted between said lower ends of said frame posts.

9. The printing apparatus of claim 3 wherein said printer mounting comprises a pair of spaced arms having opposed ends, a leg extending generally downwardly from first ends of each of said arms, a cross support positioned between said first ends of said arms and means for slidably mounting said printer mounting to said frame.

10. The printing apparatus of claim 9 wherein said upper cross rail is positioned below said impression cylinder and wherein said mounting means is a pair of hooks extending from said printer mounting for slidably attaching said printer mounting to said upper cross rail.

11. The printing apparatus of claim 1 wherein said impression cylinder is rotatably driven by the continuous web of non-rigid material pulled through the printing apparatus by the at least one post-printing processing machine.

12. The printing apparatus of claim 1 wherein said impression cylinder is at least partially driven by a main drive.

13. The printing apparatus of claims 1 further comprising means for transferring rotation of said impression cylinder to said printer.

14. The printing apparatus of claim 13 wherein said transfer means comprises a driveshaft coupled to said printer, a gear secured to said driveshaft and a gear secured to said impression cylinder and aligned for engagement with said gear on said driveshaft whereby rotation of said impression cylinder translates into rotation of said driveshaft.

15. The printing apparatus of claim 14 wherein said driveshaft is movable laterally with respect to said impression cylinder.

16. A flexographic printing apparatus for printing on a continuous web of non-rigid material, comprising:

a frame;

an impression cylinder rotatably mounted to said frame;

a printer mounting attached to said frame;

a belt-type printer mounted on said printer mounting; and means for transferring rotation of said impression cylinder to said printer;

wherein said impression cylinder is at least partially rotatably driven by the continuous web of non-rigid material being pulled through the printing apparatus by at least one post-printing processing machine and wherein said printer is operated solely by rotation of said impression cylinder.

17. The printing apparatus of claim 16 wherein said printer and said printer mounting are movable on said frame laterally relative to said impression cylinder.

18. The printing apparatus of claim 17 wherein said transfer means comprises a driveshaft coupled to said printer, a gear secured to said driveshaft and a gear secured to said impression cylinder and aligned for engagement with said gear on said driveshaft whereby rotation of said impression cylinder translates into rotation of said driveshaft.

19. The printing apparatus of claim 18 wherein said belt-type printer comprises:

a rotatable plate cylinder coupled to said driveshaft;

an adjustable belt-tensioning roller spaced from said plate cylinder for tensioning belts of different lengths;

an endless printing belt detachably wound around said plate cylinder and said belt-tensioning roller and driven by said plate cylinder;

at least one printing plate secured to an outer surface of said printing belt for transferring an image with ink onto the surface of the continuous web of non-rigid material;

a rotatable ink-carrying roller axially aligned with said plate cylinder for removing ink from an ink reservoir;

a rotatable anilox roller axially aligned with said plate cylinder and said ink-carrying roller for transferring the ink removed from said ink reservoir to said printing plate; and a belt for enabling said power cylinder to rotate said ink-carrying roller and said anilox roller.

20. The printing apparatus of claim 16 further comprising a nip roller rotatably mounted to said frame in close proximity to said impression cylinder such that said nip roller bears on said impression cylinder.

21. A process for printing on a continuous web of non-rigid material utilized in conjunction with the in-line use of a post-printing processing machine, said process comprising feeding a continuous web of non-rigid material around a nip roller rotatably mounted to a frame thence between said nip roller, and an impression cylinder, said impression cylinder being rotatably mounted to said frame and in close proximity to said nip roller such that said nip roller bears on said impression cylinder thence between said impression cylinder and a belt type printer and on to a post-printing processing machine; where said belt type printer is mounted on a printer mounting, said printer mounting being movable on said frame laterally relative to said impression cylinder.

22. A process according to claim 21 wherein the feeding of the continuous web is accomplished by pulling the continuous web around and between said nip roller, impression cylinder and the belt type printer.

23. A process according to claim 22 wherein the feeding of the continuous web is accomplished by attaching a drive mechanism to the impression cylinder.

* * * * *